US007797836B2

(12) United States Patent
Ranieri et al.

(10) Patent No.: US 7,797,836 B2
(45) Date of Patent: Sep. 21, 2010

(54) COMPACT UTILITY KNIFE

(75) Inventors: Eric Ranieri, West Hartford, CT (US); Stephen Rowlay, Sheffield (GB); Gary E Van Deursen, Avon, CT (US)

(73) Assignee: The Stanley Works, New Britain, CT (US)

( * ) Notice: Subject to any disclaimer, the term of this patent is extended or adjusted under 35 U.S.C. 154(b) by 549 days.

(21) Appl. No.: 11/194,479

(22) Filed: Aug. 2, 2005

(65) Prior Publication Data

US 2007/0028455 A1 Feb. 8, 2007
US 2008/0282546 A2 Nov. 20, 2008

(51) Int. Cl.
*B26B 1/08* (2006.01)

(52) U.S. Cl. ..... 30/162; 30/335; 30/337

(58) Field of Classification Search ..... 30/162, 30/156, 335–339, 314, 317, 320
See application file for complete search history.

(56) References Cited

U.S. PATENT DOCUMENTS

| | | | | |
|---|---|---|---|---|
| 493,075 | A | 3/1893 | Evertz | |
| 515,045 | A | 2/1894 | Von Bultzingslowen | |
| 705,441 | A * | 7/1902 | Putney | 30/162 |
| 1,444,324 | A | 2/1923 | Brooks | |
| 1,496,927 | A * | 6/1924 | Evers | 30/162 |
| 1,500,550 | A | 7/1924 | D'Hondt | |
| 1,706,251 | A | 3/1929 | Perry | |
| 1,753,441 | A * | 4/1930 | Morehouse | 81/132 |
| 1,940,855 | A | 12/1933 | Friedman | |
| 2,051,721 | A | 8/1936 | Kirangelos | |
| 2,134,973 | A | 11/1938 | Harwel | |

(Continued)

FOREIGN PATENT DOCUMENTS

| | | |
|---|---|---|
| CA | 972140 | 8/1975 |

(Continued)

OTHER PUBLICATIONS

Mator USA Online, Trapezoidal Blades, Saved on Mar. 30, 2004, http://web.archive.org/web/20030308063534/martorusa.com/cart/products.asp?grouping_id=19, Accessed on Jun. 24, 2010.*

(Continued)

*Primary Examiner*—Boyer D. Ashley
*Assistant Examiner*—Edward Landrum
(74) *Attorney, Agent, or Firm*—Pillsbury Winthrop Shaw Pittman LLP

(57) ABSTRACT

A compact utility knife includes a blade holder slidably connected to a handle. A trapezoidal utility blade detachably mounts to the blade holder via a blade lock mechanism. A slide lock mechanism selectively retains the blade holder in its extended or retracted position relative to the handle. When the blade holder is extended, the blade holder and a majority of the blade extend forwardly of a forwardmost point of the handle. Extending the blade holder significantly increases an overall length of the knife such that the knife is comfortable to use when in the extended position and longitudinally compact when in the retracted position. The knife includes a blade lock mechanism. An aperture in the front of the handle creates a gap between the blade and the handle to discourage debris on the blade from transferring to the handle when the blade is retracted.

80 Claims, 4 Drawing Sheets

U.S. PATENT DOCUMENTS

| | | | | |
|---|---|---|---|---|
| 2,265,775 | A | 12/1941 | McNamara | |
| 2,284,128 | A | 5/1942 | Bush | |
| 2,523,575 | A | 9/1950 | Kassel | |
| 2,569,080 | A * | 9/1951 | Trimble et al. | 30/320 |
| 2,599,439 | A * | 6/1952 | Drake | 30/151 |
| 2,601,723 | A * | 7/1952 | Keller | 30/162 |
| 2,632,244 | A * | 3/1953 | Belsky | 30/162 |
| 2,735,176 | A | 2/1956 | Costin | |
| 2,914,850 | A | 12/1959 | Kuhnl | |
| 2,980,966 | A | 4/1961 | Praeg | |
| 3,192,624 | A * | 7/1965 | Gringer | 30/162 |
| 3,234,649 | A | 2/1966 | Preble et al. | |
| 3,306,297 | A | 2/1967 | Voorhees et al. | |
| 3,708,881 | A * | 1/1973 | Bennett | 30/320 |
| 3,845,554 | A | 11/1974 | Joanis et al. | |
| 3,879,847 | A * | 4/1975 | Roll | 30/162 |
| 3,927,473 | A | 12/1975 | Braginetz | |
| 3,943,627 | A | 3/1976 | Stanley, Jr. | |
| 3,964,162 | A * | 6/1976 | Gerson et al. | 30/162 |
| 3,999,290 | A | 12/1976 | Wood | 30/2 |
| 4,017,969 | A | 4/1977 | Stonebraker | |
| 4,109,380 | A | 8/1978 | Anderson | 30/162 |
| 4,242,795 | A | 1/1981 | Rollband et al. | |
| 4,261,104 | A | 4/1981 | Cuscovitch | |
| 4,265,017 | A | 5/1981 | Collins | |
| 4,347,665 | A | 9/1982 | Glesser | |
| 4,408,396 | A * | 10/1983 | Scholl | 30/294 |
| 4,517,741 | A | 5/1985 | Castelluzzo | |
| 4,558,517 | A | 12/1985 | Gringer | 30/169 |
| 4,575,940 | A | 3/1986 | Wenzel | |
| 4,586,256 | A | 5/1986 | Weimann | 30/162 |
| 4,604,805 | A | 8/1986 | Krieger | |
| 4,620,369 | A | 11/1986 | Gercken | |
| 4,635,309 | A * | 1/1987 | Larsen | 30/162 |
| 4,660,284 | A | 4/1987 | Decarolis | |
| 4,663,845 | A | 5/1987 | Weimann | 30/162 |
| 4,761,882 | A | 8/1988 | Silverstein | 30/162 |
| 4,805,304 | A | 2/1989 | Knoop | 30/162 |
| 4,813,132 | A | 3/1989 | Castelluzzo | |
| 4,835,865 | A | 6/1989 | Knoop | 30/162 |
| 4,899,443 | A * | 2/1990 | Beermann | 30/162 |
| 4,936,014 | A | 6/1990 | Shannan et al. | |
| 5,095,624 | A | 3/1992 | Ennis | |
| 5,203,085 | A | 4/1993 | Berns | 30/163 |
| 5,207,696 | A | 5/1993 | Matwijcow | |
| 5,303,469 | A | 4/1994 | Yin-Han | |
| 5,344,424 | A | 9/1994 | Roberts et al. | |
| 5,384,963 | A | 1/1995 | Beermann | 30/162 |
| 5,400,512 | A | 3/1995 | Brush | |
| 5,406,707 | A | 4/1995 | Owens et al. | |
| 5,571,127 | A | 11/1996 | DeCampli | 606/167 |
| 5,749,886 | A | 5/1998 | Abidin et al. | |
| 5,864,954 | A | 2/1999 | Harrington | 30/162 |
| 5,878,501 | A | 3/1999 | Owens et al. | |
| 5,890,293 | A | 4/1999 | Gamba | 30/125 |
| 5,909,930 | A | 6/1999 | Ragland, III et al. | |
| 5,966,816 | A | 10/1999 | Roberson | |
| 5,966,817 | A | 10/1999 | Lee | 30/162 |
| 6,026,575 | A | 2/2000 | Wonderley | |
| 6,148,520 | A * | 11/2000 | Berns | 30/2 |
| 6,192,589 | B1 * | 2/2001 | Martone et al. | 30/125 |
| 6,249,975 | B1 | 6/2001 | Lin | |
| 6,263,581 | B1 | 7/2001 | Forte | |
| 6,286,215 | B1 * | 9/2001 | Panaccione | 30/169 |
| 6,314,646 | B1 * | 11/2001 | Schmidt | 30/162 |
| 6,354,007 | B1 | 3/2002 | Scarla | |
| 6,374,497 | B1 | 4/2002 | Sun | |
| 6,446,340 | B1 | 9/2002 | Ping | |
| 6,543,140 | B1 | 4/2003 | Davis | 30/2 |
| 6,550,144 | B1 * | 4/2003 | Berns | 30/162 |
| 6,645,216 | B2 * | 11/2003 | Masury et al. | 606/167 |
| 6,688,003 | B2 * | 2/2004 | Scarla | 30/156 |
| 6,742,260 | B1 | 6/2004 | Hsu | |
| 6,757,977 | B2 | 7/2004 | Dambal et al. | |
| 6,775,912 | B2 * | 8/2004 | Panfili et al. | 30/169 |
| 6,796,033 | B2 | 9/2004 | Owoc | |
| 6,907,668 | B2 | 6/2005 | Polei | 30/162 |
| 6,915,577 | B2 * | 7/2005 | Scala | 30/156 |
| 6,948,250 | B1 | 9/2005 | Caiafa et al. | |
| 6,968,622 | B2 * | 11/2005 | Ping | 30/156 |
| 7,003,833 | B2 * | 2/2006 | Feliciano | 7/148 |
| 7,134,207 | B2 * | 11/2006 | Ping | 30/125 |
| 7,475,480 | B2 | 1/2009 | Votolato | 30/2 |
| 7,520,059 | B2 | 4/2009 | Ranieri et al. | 30/162 |
| 7,540,092 | B2 | 6/2009 | Polei | 30/162 |
| 2002/0096032 | A1 | 7/2002 | Peyrot et al. | |
| 2003/0037444 | A1 * | 2/2003 | Chunn | 30/337 |
| 2003/0079294 | A1 | 5/2003 | Van Deursen et al. | |
| 2003/0150116 | A1 | 8/2003 | Scarla | |
| 2003/0154605 | A1 | 8/2003 | Chao | 30/162 |
| 2004/0107580 | A1 | 6/2004 | Ping | |
| 2004/0139614 | A1 | 7/2004 | Tebo | 30/162 |
| 2005/0055833 | A1 | 3/2005 | Scarla | |
| 2005/0188541 | A1 | 9/2005 | Brown et al. | |
| 2006/0130339 | A1 | 6/2006 | Berns | 30/162 |
| 2006/0130340 | A1 | 6/2006 | Berns | 30/162 |
| 2007/0028455 | A1 | 2/2007 | Ranieri et al. | |
| 2007/0119056 | A1 | 5/2007 | Polei | 30/162 |
| 2008/0189956 | A1 | 8/2008 | Polei | 30/162 |
| 2009/0193665 | A1 | 8/2009 | Ranieri et al. | |
| 2009/0271990 | A1 | 11/2009 | De | |

FOREIGN PATENT DOCUMENTS

| | | | |
|---|---|---|---|
| DE | 298 19 618 | U1 | 1/1999 |
| DE | 20308706 | U1 | 6/2004 |
| EP | 0893211 | B1 | 1/1999 |
| EP | 1422031 | A1 | 5/2004 |
| GB | 2 277 048 | A | 10/1994 |
| WO | WO 94/15762 | | 7/1994 |

OTHER PUBLICATIONS

Mator USA Online, Trapezoidal Blades, http://www.martorusa.com/Blades/Trapezoid-Blades?range=1%2C25%2C34, Accessed on Jun. 24, 2010.*

United Kingdom Search Report issued for Patent Application No. GB0615280.5, dated Oct. 25. 2006.

Examination Report issued for Great Britain Patent Application No. 0615280.5, dated May 29, 2009.

Six alleged photographs of Martor knives (6 pages).

Photographs of Pacific Handy Cutter S3 Knife and Box (5 pages).

Photographs of Martor Megasafe Knife and Box (6 pages).

Photographs of Martor Maxisafe KNife and Box (4 pages).

Photographs of Martor Optisafe Knife and Box (6 pages)

Optisafe Poster (2 pages).

Megasafe Poster(2 pages).

Martor Catalog (95 pages).

Martor IM chat: Alleged Apr. 21, 2009 "Chat With Martor Customer Service". (3 pages).

U.S. Office Action dated Nov. 9, 2009 for U.S. Appl. No. 12/423,551.

* cited by examiner

COMPACT UTILITY KNIFE

CROSS-REFERENCE TO RELATED APPLICATIONS

This application is related to copending application Ser. No. 11/194,448, entitled "Compact Utility Knife," filed on the same day as this application, the entire contents of which are incorporated herein by reference.

BACKGROUND OF THE INVENTION

1. Field of the Invention

This invention relates to utility knives that utilize trapezoidal utility blades and can selectively expose or protect a cutting edge of the blade.

2. Description of Related Art

A conventional utility knife includes a long handle with a blade holder slidably disposed within the handle. See, e.g., U.S. Pat. Nos. 4,242,795, 6,249,975. A trapezoidal utility blade detachably mounts to the blade holder. The standard trapezoidal blade has a cutting edge disposed on its longest edge and one or more mounting notches disposed on an opposite edge. When the blade holder is in a retracted position, the blade is disposed within and protected by the handle. When the blade holder is slid into an extended position, a small portion of the blade becomes exposed. The conventional handle is relatively long so as to provide enough longitudinal space for a user's hand to apply sufficient leverage to the blade during a cutting action, and/or to enable the user to grip the handle without being overly close to the blade's cutting edge. Unfortunately, the length and size of this handle makes the utility knife large and cumbersome when the knife is not being used. Accordingly, there remains a need for a more compact utility knife that is more easily carried while not being used but is nonetheless comfortable to use when in its operative position.

SUMMARY OF THE INVENTION

Accordingly, one aspect of one or more embodiments of this invention provides a utility knife that is compact when in a non-operable retracted position, and comfortably long when in an extended position.

Another aspect of one or more embodiments of this invention provides a knife that includes a handle and a blade holder slidingly/telescopically carried by the handle for sliding movement relative to the handle between an extended position and a retracted position. The blade holder is shaped and configured to attach to a trapezoidal or other type of utility blade. The blade holder is constructed and arranged to extend forwardly of the handle when in the extended position.

The knife may include a trapezoidal utility blade mounted to the blade holder. The blade includes an elongated cutting edge that is protected by the handle when the blade holder is in the retracted position. The cutting edge may extend forwardly of the handle by at least 1 inch when the blade holder is in the extended position. In another embodiment, at least 40% (or more preferably at least 50%) of the cutting edge extends forwardly of the handle when the blade holder is in the extended position.

The blade holder may be constructed and arranged to extend forwardly of the handle by at least 0.25 inches when in the extended position.

A retracted length of the knife when the blade holder is in the retracted position is preferably less than 4.5 inches, and may be between 3.9 and 4.9 inches.

An extended length of the knife (including a utility blade) when the blade holder is in the extended position is preferably at least 15% longer than a retracted length of the knife when the blade holder is in the retracted position. The extended length is more preferably at least 20% longer than the retracted length. The extended length is even more preferably at least 25% longer than the retracted length.

The sliding movement between the handle and blade holder may define a curved or non-linear path. The curve may have a fixed radius. The curve may generally follow an overall shape of the handle.

The handle may include an aperture through which the blade holder extends when in the extended position. In one or more embodiments, no portion of the blade holder extends through the aperture when the blade holder is in the retracted position.

The knife may further include a manually operable slide lock that selectively maintains the blade holder in the retracted or extended position. The slide lock may also include an intermediate locking position. The slide lock may include a resilient member having first and second spaced portions, the first portion being mounted to the blade holder. The slide lock may further include a push button disposed on the resilient member. When the blade handle is locked in the extended or retracted position, manually pushing the button against a biasing force of the resilient member disengages the slide lock to allow the blade handle to slide relative to the handle.

The knife may further include a manually operable blade lock disposed on the blade holder. The blade lock is manually movable from a locked position, in which the lock retains the blade in the blade holder, to a released position that allows the blade to be manually disengaged from the blade holder. The blade lock may include a resilient member having first and second portions, the first portion being mounted to the blade holder. The blade lock may also include a protrusion disposed on the second portion, the protrusion engaging a notch in an upper edge of the blade. The resilient member resiliently biases the protrusion downwardly toward the blade. A grip portion may be disposed on the resilient member. Manually lifting the grip portion upwardly lifts the protrusion out of the notch against the biasing force of the resilient member and allows the blade to be detached from the blade holder. The blade lock may be inaccessible when the blade holder is in the retracted position. The protrusion may extend forwardly of the handle when the blade holder is in the extended position.

The blade holder may have an upper edge that extends through an aperture in the handle when the blade holder is in the extended position. According to a further aspect of one or more embodiments of the present invention, the blade holder does not extend through the aperture when the blade holder is in the retracted position.

Another aspect of one or more embodiments of this invention provides a knife that includes a handle having an aperture therein. The knife also includes a blade holder slidingly carried by the handle for sliding movement relative to the handle between an extended position and a retracted position. The knife also includes a utility blade attached to the blade holder. The utility blade has a cutting edge and extends out of the aperture when the blade holder is in the extended position. The utility blade does not extend out of the aperture when the blade holder is in the retracted position. The cutting edge remains spaced from the perimeter of the aperture by at least 1 mm or at least 2 mm when the blade holder is in the extended position. The blade may have lateral surfaces that re spaced from lateral edges of the aperture by at least 1 mm or at least 2 mm when the blade holder is in the extended position. The aperture may be at least 2 mm, at least 3 mm, at least 4 mm, or at least 5 mm wide at a point on the utility blade disposed 6 mm above the cutting edge when the blade holder is in the extended position.

Additional and/or alternative advantages and salient features of the invention will become apparent from the following detailed description, which, taken in conjunction with the annexed drawings, disclose preferred embodiments of the invention.

BRIEF DESCRIPTION OF THE DRAWINGS

Referring now to the drawings which from a part of this original disclosure.

DETAILED DESCRIPTION OF PREFERRED EMBODIMENTS

Figure 1:
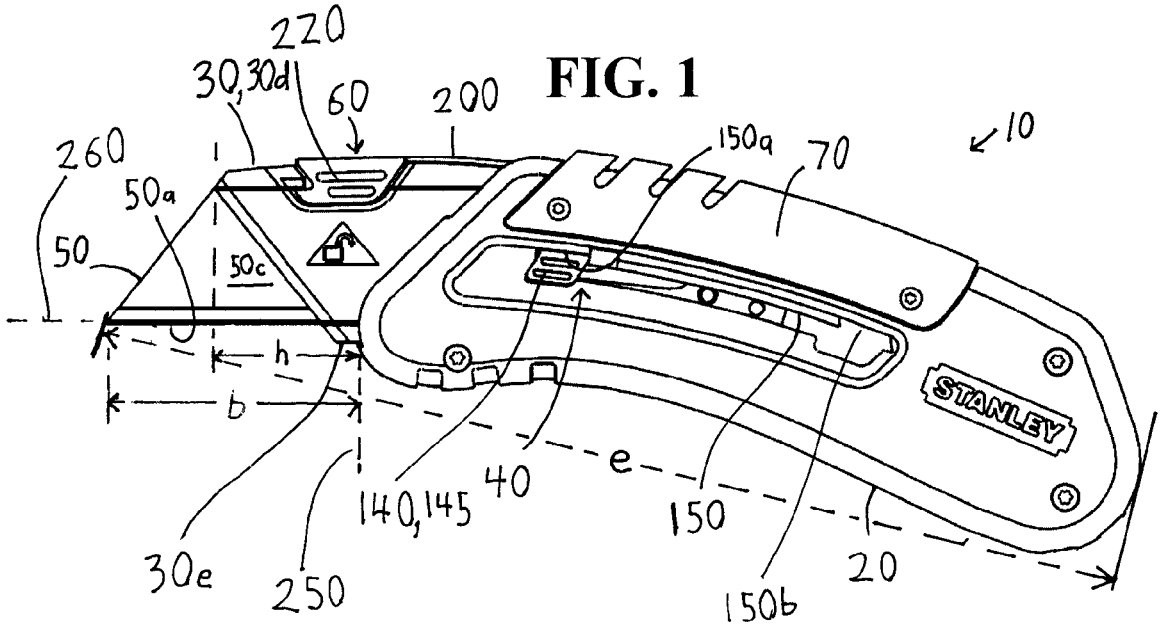
FIG. 1 is a left side view of a utility knife according to an embodiment of the present invention in an extended position.

FIGS. 1-6 illustrate a compact utility knife 10 according to an embodiment of the present invention. As shown in FIG. 1, the knife 10 includes a handle 20, a blade holder 30 slidingly connected to the handle 20, a slide lock mechanism 40 for selectively retaining the blade holder 30 in an extended position (FIG. 1) or a retracted position (FIG. 2), a trapezoidal utility blade 50 detachably mounted to the blade holder 30, and a blade lock mechanism 60 for selectively locking the blade 50 onto the blade holder 30.

As used herein, all directions are defined as shown in FIG. 1. A forward direction extends to the left of knife 10 (i.e., toward a cutting end of the knife 10). Up and down are defined as shown in FIG. 1.

Figure 3:
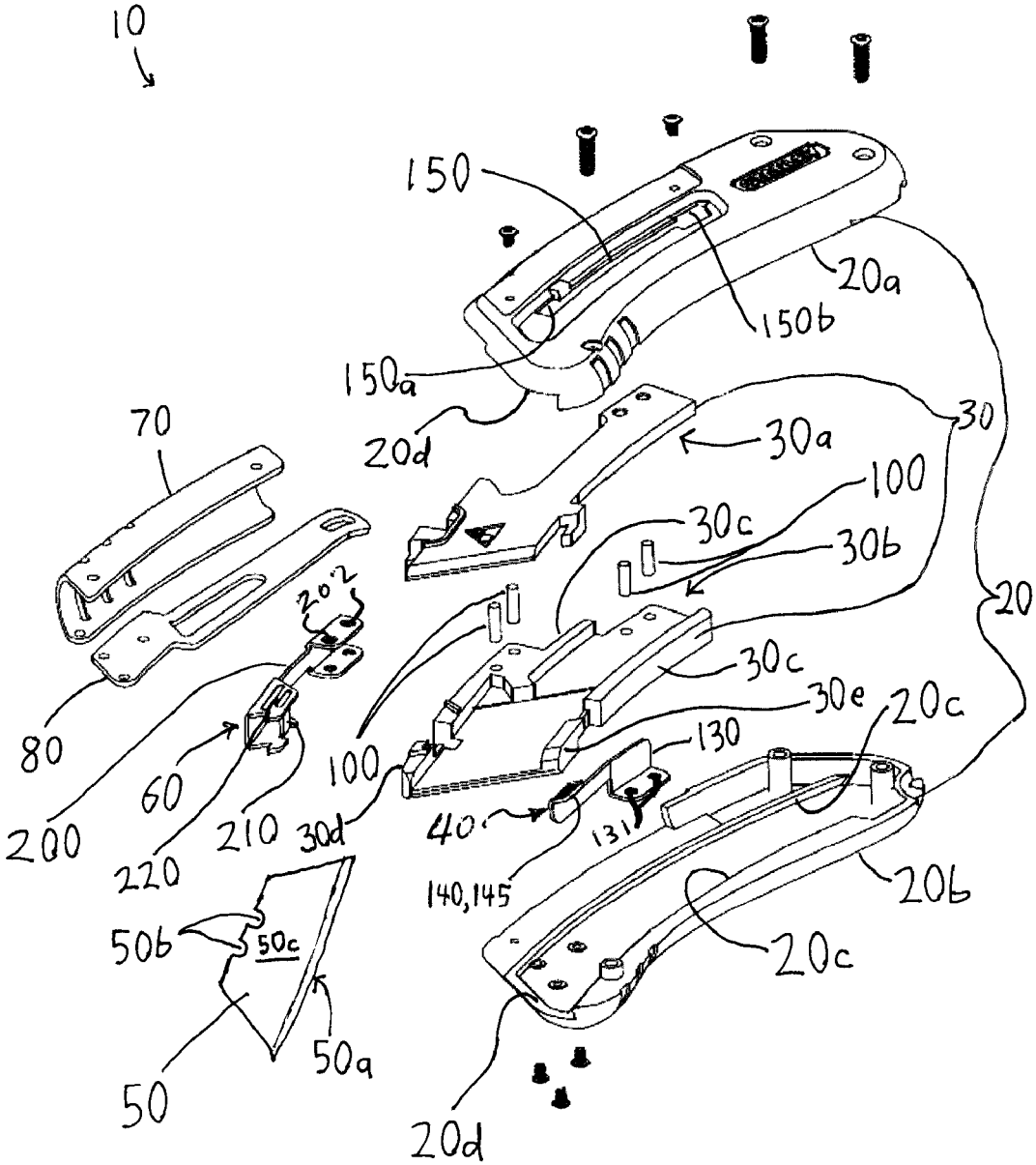
FIG. 3 is an exploded view of the utility knife in FIG. 1.
Figure 4:
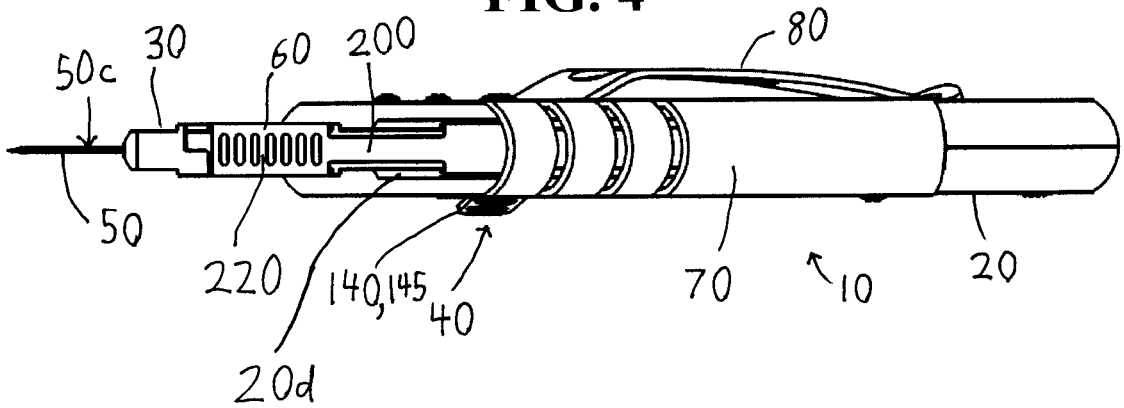
FIG. 4 is a top view of the utility knife in FIG. 1.

As shown in FIG. 3, the handle 20 comprises left and right portions 20*a*, 20*b* that are screwed or otherwise fastened together. A U-shaped cover 70 mounts to an upper edge of the handle portions 20*a*, 20*b* via screws or other fastening mechanisms. As shown in FIGS. 3 and 4, a belt clip 80 is screwed or otherwise fastened to the right handle portion 20*b*. While the illustrated handle 20 comprises a variety of components, one or more of these components may be omitted without deviating from the scope of the present invention.

Figure 5:
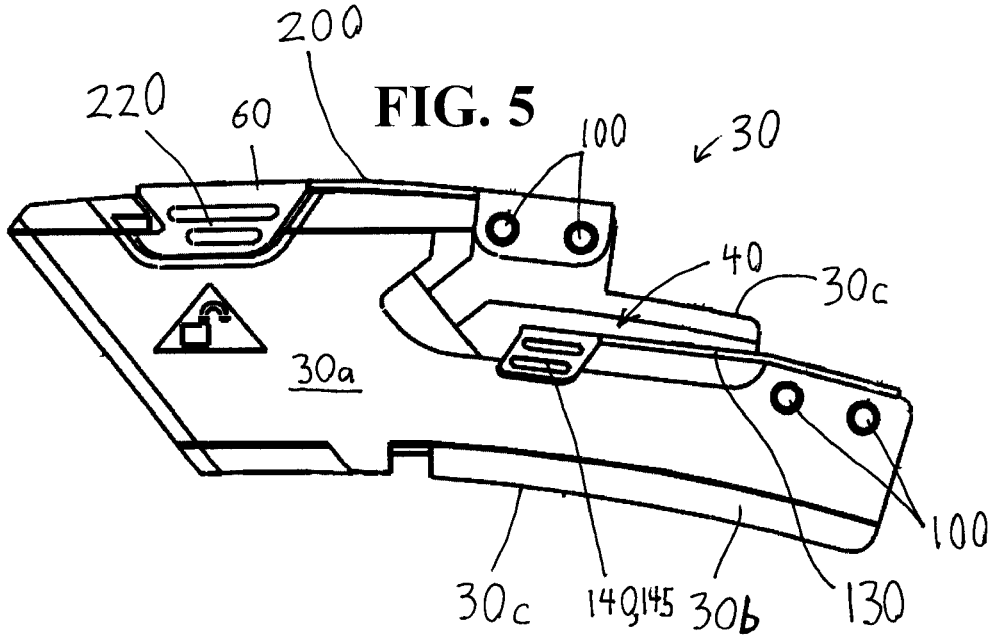
FIG. 5 is a left side view of a blade holder of the utility knife in FIG. 1.

As shown in FIGS. 3 and 5, the blade holder 30 comprises left and right holder portions 30*a*, 30*b* that are fastened to each other using rivets 100 or other suitable fastening mechanisms (e.g., screws, integral formation, glue, welding, etc.). In another contemplated embodiment, the blade holder comprises a single, integrally formed member rather than two members secured together.

As shown in FIG. 3, the handle 20 and blade holder 30 include cooperating surface features 20*c*, 30*c* that define a sliding/telescopic path of the blade holder 30. In the illustrated embodiment, the surface features 20*c*, 30*c* comprise mating channels and surfaces. Specifically, the upper and lower surface features 30*c* of the blade holder 30 slidingly engage internal surfaces 20*c* within the handle 20. In the illustrated embodiment, the sliding/telescopic path is a fixed radius curved path having a center of curvature disposed below the knife 10. Accordingly, a forward tip of the blade 50 angles progressively more downwardly as the blade holder 30 slides from its retracted position to its extended position. While the illustrated path is fixed radius curve, the path may alternatively comprise any other suitable shape (e.g., a linear or non-linear shape, a convex or concave curve, a variable radius curve, etc.) without deviating from the scope of the present invention.

Figure 2:
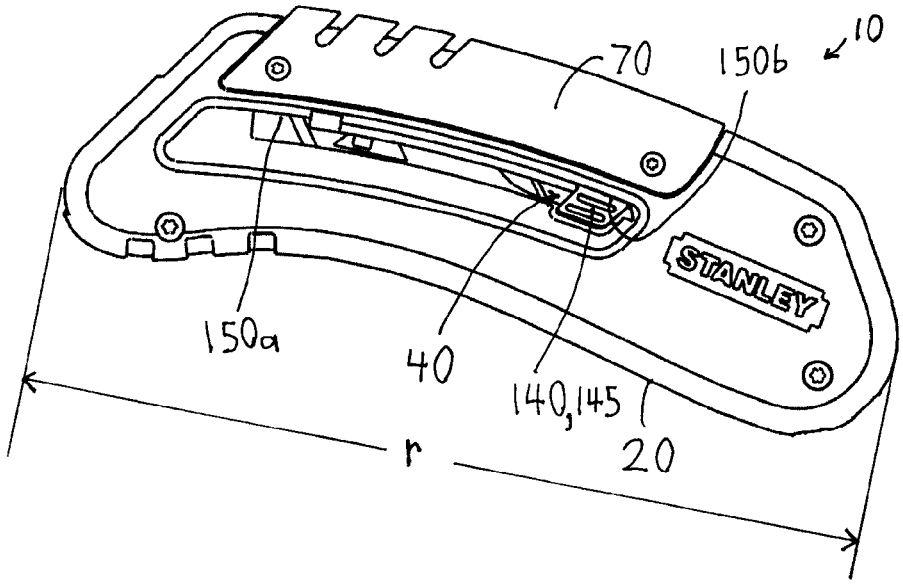
FIG. 2 is a left side view of the utility knife in FIG. 1 in a retracted position.
Figure 6:
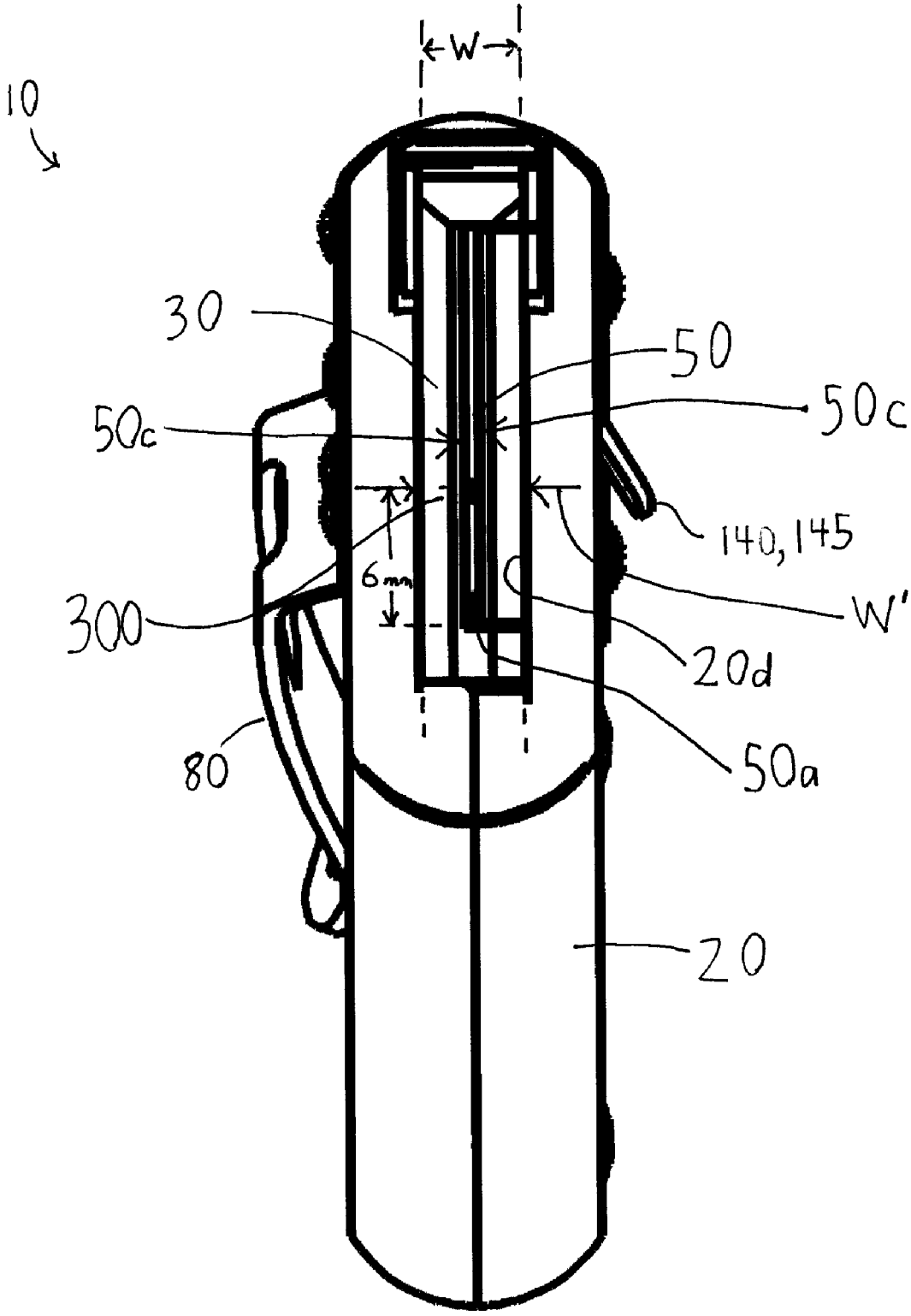
FIG. 6 is a front view of the utility knife in FIG. 1.

As shown in FIGS. 3, 4, and 6, the blade holder 30 telescopically extends out of an aperture 20*d* in the handle 20. In the illustrated embodiment, the aperture 20*d* has a contiguous perimeter, but may alternatively have an open perimeter (e.g., an open slot), without deviating from the scope of the present invention. When viewed from the side (see FIG. 1), both upper and lower edges 30*d*, 30*e* of the blade holder 30 extend out of the aperture 20*d* when the blade holder 30 is in the extended position. Conversely, when viewed from the side as shown in FIG. 2, no portion of the blade holder 30 extends out of the aperture 20*d* when the blade holder 30 is in the retracted position. However, in an alternative embodiment of the present invention, the blade holder 30 extends out of the aperture 20*d* even when the blade holder 30 is in the retracted position.

As shown in FIG. 6, the aperture 20*d* creates a significant gap between the blade 50 and the handle 20. Accordingly, if foreign debris (e.g., sap, tar, glue, adhesive, etc.) accumulates on the blade 50 during use, the gap provides sufficient clearance to reduce the likelihood that such debris will transfer to the handle 20 when the blade 50 is retracted and subsequently extended. Conversely, when the blade 50 is in the retracted position, the handle 20 encloses the blade 50 to discourage any foreign debris on the blade 50 from transferring to other objects (e.g., a person's pocket, other tools in a toolbox, etc.). The blade 50 is preferably centrally disposed in the aperture 20*d*, but may be offset in any direction without departing from the scope of the present invention. The aperture 20*d* may be at least twice as wide as the blade 50. The aperture 20*d* may be at least 3, 4, 5, 6, 8, 10, or 15 times wider than the blade 50. In one embodiment, the aperture 20*d* is between 3 and 15 times wider than the blade 50. As the blade 50 moves from its extended to its closed position, the lateral sides 50*c* of the blade 50 preferably remain spaced from the perimeter of the aperture 20*d* by a distance that is at least 1 mm, and may be at least 2 mm, at least 3 mm, or at least 4 mm. In one embodiment, the lateral sides of the blade 50 are spaced from the lateral sides of the aperture 20*d* by between 1 mm and 5 mm.

The cutting edge 50*a* may be spaced from the perimeter of the aperture 20*d* by a cutting edge gap that is at least 1 mm as the blade 50 retracts from the extended to the retracted position. The cutting edge gap may be at least 2 mm, at least 3 mm, or at least 4 mm. In one embodiment, the cutting edge gap is between 1 and 5 mm.

As shown in FIG. 6, a width W of the aperture 20*d* is preferably large enough to create a gap between the lateral sides of the blade 50 and the lateral sides of the aperture 20*d*. The width W may be between 1 and 10 mm. The width W may be between 2 and 11 mm. The width W may be between 3 and 10 mm. The width W may be greater than 1 mm, greater than 2 mm, greater than 3 mm, or greater than 4 mm. In one embodiment, the width W is about 5.3 mm.

A width W' of the aperture 20*d* is defined at a point 300 on the utility blade 50 disposed 6 mm above the cutting edge 50*a* (i.e., a point on the blade 50 that is spaced from the cutting edge 50*a* by 6 mm in a direction perpendicular to the linear cutting edge 50*a*). The width W' may be greater than 2 mm, greater than 3 mm, or greater than 4 mm. In one embodiment, the width W' is between 3 and 10 mm. In one embodiment, the width W' is about 5.3 mm.

The width W may vary over its height. For example, in one embodiment, the width W is smaller toward an upper edge of the blade 50, and relatively larger toward the cutting edge 50*a* of the blade 50. A portion of the aperture 20*d* that is disposed adjacent to an upper half of the utility blade 50 is narrower than a portion of the aperture 20*d* that is disposed adjacent the lower half of the utility blade 50. In one embodiment, the lower halves of the lateral surfaces 50*c* of the utility blade 50 (i.e., portions of the lateral surfaces 50*c* that are disposed below an imaginary line that is parallel to and equally spaced from the upper and lower edges of the blade 50) are spaced from the lateral edges of the aperture 20*d* by at least 1 mm when the utility blade 50 is in the extended position. The lower halves of the lateral surfaces 50*c* may be spaced from the lateral edges of the aperture 20*d* by at least 2 mm or at least 3 mm when the utility blade 50 is in the extended position. The upper portions of the lateral surfaces 50*c* may be disposed closer to the lateral edges of the aperture 20*d*. The narrower upper portion of the aperture 20*d* may enable the handle 20 to laterally support the blade 50, while the relatively wider lower portion of the aperture 20*d* reduces the likelihood that debris will transfer from the blade 50 to the handle 20 when the blade 50 slides to its retracted position.

While the illustrated enlarged aperture 20*d* is shown in connection with a utility knife 10 that includes a blade carrier 30 that extends forward of the handle 20, an enlarged aperture according to the present invention may alternatively be incorporated into various conventional utility knives. Conversely, a utility knife according to the present invention need not include an enlarged aperture 20*d*. Indeed, the gap formed by the aperture 20*d* may be eliminated without deviating from the scope of the present invention. In such an embodiment, the aperture 20*d* may scrape against the sides 50*c*, top, and/or cutting edge 50*a* of the blade 50 as the blade 50 extends and retracts. Such scraping may scrape debris from the blade 50 when the blade 50 is retracted and/or provide lateral support to the extended blade 50.

As shown in FIGS. 1-3, an overall longitudinal shape of the handle 30 generally mimics the sliding path. A resulting curvature of the handle 20 makes it more comfortable to grip.

As can be appreciated from FIG. 3, the slide lock mechanism 40 comprises a resilient member 130 constructed and arranged to be mounted at one end to the blade holder 30. In the illustrated embodiment, the resilient member 130 has openings 131 that enable the resilient member 130 to be fastened to the blade holder 30 by use of two of the rivets 100 that fasten the blade holder portions 30*a*, 30*b* together. A projection 140 extends laterally outwardly from an opposite end of the resilient member 130 to define a push button 145. As shown in FIGS. 1 and 3, the projection 140 and push button 145 extend outwardly through a slot 150 in the handle 20. The slot 150 generally mimics the sliding path of the blade holder 30. An upper surface of the slot 150 includes forward and rearward notches 150*a*, 150*b*. The resilient member 130 urges the projection 140 upwardly toward the notches 150*a*, 150*b*. As shown in FIG. 1, when the blade holder 30 is in the extended position, the projection 140 engages the notch 150*a* to retain the blade holder 30 in the extended position. Conversely, as shown in FIG. 2, when the blade holder 30 is in the retracted position, the projection 140 engages the notch 150*b* to retain the blade holder 30 in the fully retracted position.

To move the blade holder 30 between the retracted and extended positions, a user depresses the button 145 downwardly and/or inwardly against the biasing force of the resilient member 130 to disengage the projection 140 from the notch 150*a* or 150*b*. The user then pushes the button 145 in a forward or rearward direction to extend or retract the blade holder 30 and blade 50. Once the user moves the blade holder 30 into the extended or retracted position and releases the button 145, the projection 140 engages the corresponding notch 150*a*, 150*b* to lock the blade holder 30 in the new position. While not illustrated, additional notches may be formed in the slot 150 to provide additional locking positions for the blade holder 30 (e.g., a partially extended/intermediate position in which only a small portion of the blade 50 extends out of the handle 20, a hyper-extended position, etc.).

In the illustrated embodiment, the extended and retracted positions of the blade holder 30 are the fully extended and fully retracted positions of the blade holder 30. It is nonetheless contemplated that the blade holder 30 could extend or retract beyond these positions without deviating from the scope of the present invention.

As shown in FIG. 3, the blade 50 comprises a standard trapezoidal utility blade having an elongated cutting edge 50*a* disposed on its lower edge. Two mounting notches 50*b* are disposed on an upper edge of the blade 50. The upper shorter edge is not sharpened. The blade 50 can be formed in a conventional process as known in the art. While the illustrated knife 10 uses a trapezoidal blade 50, any other suitable utility blade may be used instead of a trapezoidal blade without deviating from the scope of the present invention. For example, a knife according to the present invention may be designed for use with a rectangular utility blade.

As shown in FIG. 5, the blade lock mechanism 60 comprises a resilient member 200 mounted at one end to the blade holder 30. In the illustrated embodiment, the resilient member 200 has a plurality of openings 202 that enable the lock mechanism 60 to be fastened to the blade holder 30 using two of the rivets 100 that fasten the blade holder portions 30*a*, 30*b* together. As shown in FIG. 3, a protrusion/detent 210 extends downwardly from a forward portion of the resilient member 200. The resilient member 200 biases the protrusion 210 downwardly. A grip portion 220 provides an exterior grip surface disposed on the forward portion of the resilient member 200. When the blade 50 is inserted into the blade holder 30, the protrusion 210 engages a notch 50*b* of the blade 50 to retain the blade 50 in the blade holder 30. The blade 50 may be detached from the blade holder 30 by manually lifting the grip portion 220 against the biasing force of the resilient member 200 until the protrusion 210 disengages from the notch 50*b*. The blade 50 may then be manually moved forwardly out of the blade holder 30.

In the illustrated embodiment, the resilient member 200, protrusion 210, and grip portion 220 are all integrally formed from a unitary sheet material. However, these components may alternatively be separately formed and subsequently connected to each other without deviating from the scope of the present invention.

As shown in the embodiment of FIGS. 1 and 2, the blade lock mechanism 60 is only accessible when the blade holder 30 is in the extended position. When the blade holder 30 is in the retracted position, the blade lock mechanism 60 is disposed at least partially within the handle 20 so as to prevent the blade lock mechanism 60 from releasing the blade 50 when the knife 50 is not being used. In another contemplated embodiment, the blade lock mechanism 60 can be accessed when retracted, but cannot be moved to release the blade 50. In yet another embodiment, the blade lock mechanism 60 can both be accessed and used to release the blade 50 whether retracted or extended.

The illustrated resilient members 130, 200 preferably comprise a strong, elastically deformable material such as spring steel that is stamped and bent to form the resilient members 130, 200. However, the resilient member 130, 200 may alternatively comprise any other suitable material or composite of materials and may be formed in any other suitable manner without deviating from the scope of the present invention.

While particular slide lock and blade lock mechanisms 40, 60 are illustrated, any other suitable selective locking mechanism may alternatively be used without deviating from the scope of the present invention.

The utility knife 10 is compact when in the retracted position and comfortably long when in the extended position. As shown in FIG. 1, the blade holder 30 extends forwardly of the handle 20 by a distance h when in the extended position. The distance h may be at least 0.25 inches, or more preferably at least 0.5 inches. In one embodiment, the distance h is between 0.7 inches and 1.0 inches, an preferably about 0.85 inches. In one embodiment, the distance h is between 0.5 and 2 inches. Similarly, the blade 50 extends forwardly of the handle 20 by a distance b when the blade holder 30 is in the extended position. The distance b may be at least 0.75 inches, or more preferably at least 1 inch, or more preferably at least 1.25 inches. In one embodiment, the distance b is between 1.2 and 1.6 inches, and preferably about 1.45 inches. The distance b may be between 1 and 3 inches. The distance b is preferably at least 40% of the length of the cutting edge 50*a*, is more preferably at least 50% of the length of the cutting edge 50*a*, and is even more preferably greater than or about 60% of the length of the cutting edge 50*a*, such that the blade 50 extends significantly forwardly from the handle 20. Indeed, the distance b could be larger than the length of the cutting edge 50*a* such that the blade 50 is disposed entirely forward of the handle 20. The distances b, h are measured from a plane 250 that is tangent to a forwardmost point on the handle 20 and is perpendicular to an axis 260 defined by the cutting edge 50*a*.

As shown in FIG. 1, the protrusion 210 of the blade lock 60 also extends forwardly of the handle 20 when the blade holder 30 is in the extended position. Accordingly, the blade lock 60 is easily accessible when the blade holder 30 is in the extended position.

As shown in FIG. 1, an overall extended length e of the knife 10 is defined as the largest distance between any two points on the knife 10 (including the blade 50). As shown in FIG. 2, a overall retracted length r of the knife 10 is defined in the same manner. The length e is preferably between 5 and 7 inches, and even more preferably less than 6.0 inches. In one embodiment, the length e is about 5.7 inches. The length r is preferably less than 5 inches, and may be less than 4.5 inches. The length r is preferably between 3.9 and 4.9 inches. In one embodiment, the length r is about 4.3 inches. The length e is preferably at least 15% larger than the length r (i.e., a ratio e:r is at least 1.15:1). The length e is more preferably at least 20% larger than the length r, is even more preferably at least 25% larger than the length r, and is even more preferably at least 30% larger than the length r. In one embodiment, the length e is about 33% larger than the length r. Accordingly, the knife 10 is substantially longer in its operative position than it is in its retracted position, making the knife 10 comfortable to use and easy to store/carry.

The distance h is preferably at least 5% of the distance r, is more preferably at least 10% of the distance r, and is even more preferably at least 15% of the distance r. In the illustrated embodiment, the distance h is approximately 20% of the distance r such that extending the blade holder 30 significantly extends an overall length of the knife 10.

The knife 10 may also include a blade storage compartment for storing replacement blade(s) 50.

The foregoing description is included to illustrate the operation of the preferred embodiments and is not meant to limit the scope of the invention. To the contrary, those skilled in the art should appreciate that varieties may be constructed and employed without departing from the scope of the invention, aspects of which are recited by the claims appended hereto.

What is claimed is:

1. A knife comprising:

a handle;

a blade holder slidingly carried by the handle for sliding movement relative to the handle between a fully extended position and a retracted position, the blade holder being constructed and arranged to extend forwardly of the handle when in the fully extended position; and a utility blade mounted to the blade holder for movement with the blade holder relative to the handle, the utility blade having first and second parallel linear edges, a mounting notch formed in the first linear edge, and a cutting edge, wherein when the blade holder is in the fully extended position, the blade is in an operative position in which the utility blade is locked to the blade holder and extends forwardly of the blade holder and handle, wherein a retracted length of the knife when the blade holder is in the retracted position is less than 5 ¼ inches, and wherein the blade holder is constructed and arranged to extend forwardly of the handle by at least 1 inch when in the fully extended position.

2. The knife of claim 1, wherein the cutting edge is an elongated cutting edge that is protected by the handle when the blade holder is in the retracted position.

3. The knife of claim 1, wherein the blade remains spaced from the handle as the blade holder slides between the fully extended and retracted positions.

4. The knife of claim 1, wherein at least 40% of the cutting edge extends forwardly of the handle when the blade holder is in the fully extended position.

5. The knife of claim 4, wherein at least 50% of the cutting edge extends forwardly of the handle when the blade holder is in the fully extended position.

6. The knife of claim 5, wherein the cutting edge comprises a linear cutting edge that extends along the second linear edge.

7. The knife of claim 1, wherein a retracted length of the knife when the blade holder is in the retracted position is between 3.9 and 4.9 inches.

8. The knife of claim 1, wherein the blade extends forwardly of the handle by at least 1 inch when the blade holder is in the fully extended position.

9. The knife of claim 1, wherein an extended length of the knife when the blade holder is in the fully extended position is at least 15% longer than a retracted length of the knife when the blade holder is in the retracted position.

10. The knife of claim 9, wherein the extended length is at least 20% longer than the retracted length.

11. The knife of claim 10, wherein the extended length is at least 25% longer than the retracted length.

12. The knife of claim 1, wherein the sliding movement between the handle and blade holder defines a curved path.

13. The knife of claim 1, wherein:

the cutting edge of the utility blade extends over an entire length of the second edge of the blade; and the utility blade substantially has the shape of an isosceles trapezoid.

14. The knife of claim 1, wherein the utility blade further comprises third and fourth linear edges diverge from each other as they diverge from the first linear edge.

15. The knife of claim 1, wherein the blade holder is constructed and arranged such that when it is in the fully extended position, the blade holder extends at least 1 inch forwardly of any part of the knife that remains stationary relative to the handle when the blade holder slides between its fully extended and retracted positions.

16. The knife of claim 1, wherein the retracted length is less than 5 inches.

17. The knife of claim 1, wherein the retracted position comprises a position in which the entire blade holder is disposed inside the handle.

18. The knife of claim 1, wherein the handle has a fixed, static length.

19. The knife of claim 1, wherein a front end of the handle and a rear end of the handle necessarily slide synchronously relative to the blade holder when the blade holder slides between its fully extended and retracted positions.

20. The knife of claim 1, wherein the retracted position comprises a position in which the entire blade is disposed inside the handle.

21. The knife of claim 1, wherein sliding the blade holder from its retracted position to its fully extended position necessarily increases a length of the knife.

22. The knife of claim 1, further comprising a manually operable slide lock that selectively maintains the blade holder in the fully extended position relative to the handle.

23. The knife of claim 1, wherein the handle comprises an aperture through which the blade holder extends when in the fully extended position, and wherein no portion of the blade holder extends through the aperture when the blade holder is in the retracted position.

24. The knife of claim 1, wherein:

the handle comprises an aperture through which the blade holder extends when in the fully extended position, and wherein no portion of the blade holder extends through the aperture when the blade holder is in the retracted position; and when the blade holder slides between the fully extended and retracted positions, the blade remains spaced by at least 1 mm from any part of the knife that remains stationary relative to the handle as the blade holder moves between the fully extended and retracted positions.

25. The knife of claim 1, wherein:

the utility blade detachably mounts to the blade holder;

the knife further comprises a manually operable blade lock disposed on the blade holder, the blade lock being manually movable from a locked position, in which the lock retains the blade in the blade holder, to a released position that allows the blade to be manually disengaged from the blade holder; and wherein the entire blade lock is slidably movable with the blade holder relative to the handle when the blade holder slides between the fully extended and retracted positions.

26. The knife of claim 1, wherein:

the utility blade detachably mounts to the blade holder;

the knife further comprises a manually operable blade lock disposed on the blade holder, the blade lock being manually movable from a locked position, in which the lock retains the blade in the blade holder, to a released position that allows the blade to be manually disengaged from the blade holder; and the blade lock is manually inaccessible when the blade holder is in the retracted position.

27. The knife of claim 1, wherein an extended length of the knife when the blade holder is in the fully extended position is at least 5 inches long.

28. The knife of claim 1, wherein:

the cutting edge of the utility blade extends over an entire length of the second edge of the blade;

the utility blade substantially has the shape of an isosceles trapezoid;

the cutting edge is protected by the handle when the blade holder is in the retracted position;

at least 50% of the cutting edge extends forwardly of the handle when the blade holder is in the fully extended position;

an extended length of the knife when the blade holder is in the fully extended position is at least 20% longer than a retracted length of the knife when the blade holder is in the retracted position;

the extended length is at least 5 inches long;

the utility blade detachably mounts to the blade holder;

the knife further comprises a manually operable blade lock disposed on the blade holder, the blade lock being manually movable from a locked position, in which the lock retains the blade in the blade holder, to a released position that allows the blade to be manually disengaged from the blade holder; and the entire blade lock is slidably movable with the blade holder relative to the handle when the blade holder slides between the fully extended and retracted positions;

the blade lock comprises a protrusion that engages the mounting notch when the blade lock is in the locked position, but does not engage the mounting notch when the blade lock is in the released position;

the blade lock is movable between the locked and released positions when the blade holder is in the fully extended position; and the protrusion extends forwardly of the handle when the blade holder is in the fully extended position.

29. The knife of claim 28, wherein:

the handle comprises an aperture through which the blade holder extends when in the fully extended position, and wherein no portion of the blade holder extends through the aperture when the blade holder is in the retracted position;

when the blade holder slides between the fully extended and retracted positions, the blade remains spaced by at least 1 mm from any part of the knife that remains stationary relative to the handle as the blade holder moves between the fully extended and retracted positions;

the blade holder is constructed and arranged such that when it is in the fully extended position, the blade holder extends at least 1 inch forwardly of any part of the knife that remains stationary relative to the handle when the blade holder slides between its fully extended and retracted positions;

the blade lock is manually inaccessible when the blade holder is in the retracted position;

sliding the blade holder from its retracted position to its fully extended position necessarily increases a length of the knife; and the retracted position comprises a position in which the entire blade holder is disposed inside the handle.

30. The knife of claim 29, further comprising a manually operable slide lock that selectively maintains the blade holder in the fully extended position relative to the handle.

31. The knife of claim 1, wherein:

the handle is longitudinally elongated, and the cutting edge extends along the longitudinal direction of the handle.

32. The knife of claim 1, wherein a portion of the cutting edge is protected by the blade holder when the blade holder is in the fully extended position.

33. A knife comprising:

a handle; and a blade holder slidingly carried by the handle for sliding movement relative to the handle between an extended position and a retracted position, the blade holder being shaped and configured to attach to a utility blade, the blade holder being constructed and arranged to extend forwardly of the handle when in the extended position, wherein the blade holder is shaped and configured to attach to a trapezoidal utility blade, wherein a retracted length of the knife when the blade holder is in the retracted position is less than 5 ¼ inches, wherein the blade holder comprises a first surface configured and arranged to mate with an upper linear edge of the trapezoidal blade when the blade is attached to the blade holder, and a second surface facing the first surface, the second surface being configured and arranged to mate with a lower linear cutting edge of the trapezoidal blade when the blade is attached to the blade holder, and wherein the blade holder is constructed and arranged such that when it is in the extended position, the blade holder extends at least 1 inch forwardly of a plane that is tangent to a forwardmost part of the knife that remains stationary relative to the handle when the blade holder moves between its extended and retracted positions.

34. The knife of claim 33, wherein the extended position comprises a fully extended position, and wherein when the blade holder is in the fully extended position, the blade is in an operative position in which the utility blade is locked to the blade holder.

35. The knife of claim 33, further comprising an isosceles trapezoidal utility blade mounted to the blade holder, a cutting edge of the utility blade extending over an entire length of a longest edge of the blade, the utility blade having at least one notch disposed on an edge opposite the cutting edge.

36. The knife of claim 35, wherein:

the utility blade detachably mounts to the blade holder, the knife further comprises a manually operable blade lock disposed on the blade holder, the blade lock being manually movable from a locked position, in which the lock retains the blade to the blade holder, to a released position that allows the blade to be manually disengaged from the blade holder, the extended position comprises a fully extended position, and wherein the blade lock is movable between the locked and released positions when the blade holder is in the fully extended position.

37. The knife of claim 35, wherein an extended length of the knife when the blade holder is in the extended position is at least 5 inches long.

38. The knife of claim 35, wherein when the blade holder is in the extended position, the blade extends forwardly of the blade holder and handle.

39. The knife of claim 33, wherein:

the knife further comprises a manually operable blade lock disposed on the blade holder, the blade lock being manually movable from a locked position, in which the lock is configured and arranged to retain the blade in the blade holder, to a released position configured and arranged to allow the blade to be manually disengaged from the blade holder;

wherein the entire blade lock is movable with the blade holder relative to the handle when the blade holder slides between the extended and retracted positions; and the blade lock is movable between the locked and released positions when the blade holder is in the extended position.

40. The knife of claim 33, wherein:

the knife further comprises a manually operable blade lock disposed on the blade holder, the blade lock being manually movable from a locked position, in which the lock is configured and arranged to retain the blade in the blade holder, to a released position configured and arranged to allow the blade to be manually disengaged from the blade holder;

the blade lock is manually inaccessible when the blade holder is in the retracted position; and the blade lock is movable between the locked and released positions when the blade holder is in the extended position.

41. The knife of claim 33, wherein the blade holder further comprises third and fourth surfaces that face each other and are configured and arranged to mate with opposing side surfaces of the trapezoidal blade.

42. The knife of claim 33, wherein the retracted length of the knife when the blade holder is in the retracted position is less than 5 inches.

43. The knife of claim 33, wherein the retracted position comprises a position in which the entire blade holder is disposed inside the handle.

44. The knife of claim 33, wherein the handle has a fixed, static length.

45. The knife of claim 33, wherein a front end of the handle and a rear end of the handle necessarily move synchronously relative to the blade holder when the blade holder moves between its extended and retracted positions.

46. The knife of claim 33, wherein sliding the blade holder from its retracted position to its extended position necessarily increases a length of the knife.

47. The knife of claim 33, further comprising a manually operable slide lock that selectively maintains the blade holder in the extended position relative to the handle.

48. The knife of claim 33, wherein the handle comprises an aperture through which the blade holder extends when in the extended position, and wherein no portion of the blade holder extends through the aperture when the blade holder is in the retracted position.

49. The knife of claim 33, wherein the blade holder is telescopically carried by the handle for telescopic movement relative to the handle between the extended position and the retracted position.

50. The knife of claim 33, wherein:

the blade holder further comprises third and fourth surfaces that face each other and are configured and arranged to mate with opposing side surfaces of the trapezoidal blade;

the knife further comprises a manually operable blade lock disposed on the blade holder, the blade lock being manually movable from a locked position, in which the lock is configured and arranged to retain the blade in the blade holder, to a released position configured and arranged to allow the blade to be manually disengaged from the blade holder;

the entire blade lock is movable with the blade holder relative to the handle when the blade holder slides between the extended and retracted positions;

the blade lock is movable between the locked and released positions when the blade holder is in the extended position;

the blade lock comprises a protrusion that is configured and positioned to engage a mounting notch in the upper linear edge of the blade when the blade lock is in the locked position;

the protrusion is configured and positioned so as to not engage the mounting notch when the blade lock is in the released position; and the handle has a fixed, static length.

51. The knife of claim 50, wherein:

the handle comprises an aperture through which the blade holder extends when in the extended position, and wherein no portion of the blade holder extends through the aperture when the blade holder is in the retracted position;

the blade holder is constructed and arranged such that when it is in the extended position, the blade holder extends at least 0.5 inches forwardly of any part of the knife that remains stationary relative to the handle when the blade holder moves between its extended and retracted positions;

the blade lock is manually inaccessible when the blade holder is in the retracted position;

the retracted position comprises a position in which the entire blade holder is disposed inside the handle;

sliding the blade holder from its retracted position to its extended position necessarily increases a length of the knife;

a front end of the handle and a rear end of the handle necessarily move synchronously relative to the blade holder when the blade holder moves between its extended and retracted positions; and the retracted length of the knife when the blade holder is in the retracted position is less than 5 inches.

52. The knife of claim 51, wherein the knife further comprises a manually operable slide lock that selectively maintains the blade holder in the extended position relative to the handle.

53. The knife of claim 33, wherein:

the handle is longitudinally elongated, and the blade holder is shaped and configured such that when a trapezoidal utility blade is attached to the blade holder, a cutting edge of the trapezoidal utility blade extends along the longitudinal direction of the handle.

54. The knife of claim 33, wherein the blade holder is shaped and configured such that when a trapezoidal utility blade is attached to the blade holder and the blade holder is in the extended position, a portion of a cutting edge of the trapezoidal utility blade is protected by the blade holder.

55. A knife comprising:

a handle;

a blade holder carried by the handle for telescopic movement relative to the handle between an extended position and a retracted position, the blade holder being constructed and arranged to extend forwardly of the handle when in the extended position; and a utility blade mounted to the blade holder for movement with the blade holder relative to the handle, the utility blade having first and second parallel linear edges, a mounting notch formed in the first linear edge, and a cutting edge, wherein the extended position comprises an operative position in which the utility blade is locked to the blade holder, wherein the retracted position comprises a position in which the entire blade holder is disposed inside the handle, wherein a portion of the cutting edge is protected by the blade holder when the blade holder is in the extended position, and wherein, when the blade holder is in the extended position, the blade holder extends at least 1 inch forwardly of a plane that is tangent to a forwardmost part of the knife that remains stationary relative to the handle when the blade holder moves between its extended and retracted positions, wherein the plane is perpendicular to an axis of the cutting edge.

56. The knife of claim 55, wherein the extended position comprises a fully extended position.

57. The knife of claim 55, wherein:

the cutting edge of the utility blade extends over an entire length of the second edge of the blade; and the utility blade substantially has the shape of an isosceles trapezoid.

58. The knife of claim 55, wherein:

the utility blade detachably mounts to the blade holder, the knife further comprises a manually operable blade lock disposed on the blade holder, the blade lock being manually movable from a locked position, in which the lock retains the blade in the blade holder, to a released position that allows the blade to be manually disengaged from the blade holder, the extended position comprises a fully extended position, and the blade lock is movable between the locked and released positions when the blade holder is in the fully extended position.

59. The knife of claim 55, wherein a retracted length of the knife when the blade holder is in the retracted position is less than 5 inches.

60. The knife of claim 55, wherein the handle has a fixed, static length.

61. The knife of claim 55, wherein a front end of the handle and a rear end of the handle necessarily telescopically move synchronously relative to the blade holder when the blade holder moves between its extended and retracted positions.

62. The knife of claim 55, wherein the retracted position comprises a position in which the entire blade is disposed inside the handle.

63. The knife of claim 55, wherein telescopically moving the blade holder from its retracted position to its extended position necessarily increases a length of the knife.

64. The knife of claim 63, wherein the extended position comprises an operative position of the knife.

65. The knife of claim 55, further comprising a manually operable slide lock that selectively maintains the blade holder in the extended position relative to the handle.

66. The knife of claim 55, wherein the handle comprises an aperture through which the blade holder extends when in the extended position, and wherein no portion of the blade holder extends through the aperture when the blade holder is in the retracted position.

67. The knife of claim 55, wherein:

the handle comprises an aperture through which the blade holder extends when in the extended position, and wherein no portion of the blade holder extends through the aperture when the blade holder is in the retracted position; and when the blade holder telescopically moves between the extended and retracted positions, the blade remains spaced by at least 1 mm from any part of the knife that remains stationary relative to the handle as the blade holder moves between the extended and retracted positions.

68. The knife of claim 55, wherein:

the utility blade detachably mounts to the blade holder;

the knife further comprises a manually operable blade lock disposed on the blade holder, the blade lock being manually movable from a locked position, in which the lock retains the blade in the blade holder, to a released position that allows the blade to be manually disengaged from the blade holder; and wherein the entire blade lock is movable with the blade holder relative to the handle when the blade holder moves between the extended and retracted positions.

69. The knife of claim 68, wherein the blade lock comprises a protrusion that engages the mounting notch when the blade lock is in the locked position, but does not engage the mounting notch when the blade lock is in the released position.

70. The knife of claim 68, wherein the blade lock is manually inaccessible when the blade holder is in the retracted position.

71. The knife of claim 55, wherein an extended length of the knife when the blade holder is in the extended position is at least 5 inches long.

72. The knife of claim 55, wherein when the blade holder is in the extended position, the blade extends forwardly of the blade holder and handle.

73. The knife of claim 55, wherein:

the handle is longitudinally elongated, and the cutting edge extends along the longitudinal direction of the handle.

74. A knife comprising:

a handle;

a blade holder telescopically carried by the handle for telescopic movement relative to the handle between a fully extended position and a retracted position, the blade holder being constructed and arranged to extend forwardly of the handle when in the fully extended position, the blade holder being shaped and configured to attach to a utility blade having a notch; and a manually operable blade lock comprising a resilient member mounted to the blade holder, a manually movable member mounted on the blade holder, the manually movable member being manually movable between a lock position and a release position to enable the locking and releasing of a utility blade to the blade holder, the manually movable member being movable between its lock and release positions while the blade holder is in its fully extended position, and a protrusion operatively connected to the manually movable member such that when the blade is positioned in a lockable position relative to the blade holder (a) the protrusion is positioned to be able to engage the notch in the blade to retain the blade in the blade holder when the manually movable member is in its lock position, and (b) the protrusion is positioned such that it would not engage the notch in the blade when the manually movable member is in its release position, the resilient member resiliently biasing the protrusion toward the notch, wherein the blade lock is shaped and configured such that when the utility blade is attached to the blade holder and the protrusion is positioned to be resiliently held in the notch, manually forcing the manually movable member from its lock position to its release position moves the protrusion to a position in which it would be out of the notch against the biasing force of the resilient member to allow the blade to be detached from the blade holder, wherein a retracted length of the knife when the blade holder is in the retracted position is less than 5 ¼ inches, wherein the handle comprises an aperture through which the blade holder extends when in the fully extended position, and wherein no portion of the blade holder extends through the aperture when the blade holder is in the retracted position.

75. The knife of claim 74, wherein the manually movable member is manually inaccessible when the blade holder is in the retracted position.

76. The knife of claim 74, wherein:

the protrusion extends forwardly of the handle when the blade holder is in the extended position;

the retracted position comprises a position in which the entire blade holder is disposed inside the handle;

the blade holder is constructed and arranged to extend forwardly of the handle by at least 0.5 inches when in the fully extended position;

the entire blade lock is telescopically movable with the blade holder relative to the handle when the blade holder slides between the fully extended and retracted positions;

the entire blade lock is telescopically movable with the blade holder relative to the handle as the blade holder moves between its fully extended and retracted positions; and the retracted position comprises a position in which the entire blade holder is disposed inside the handle.

77. The knife of claim 74, further comprising a utility blade having a notch, wherein the utility blade is attached to the blade holder, wherein the protrusion of the blade lock engages the notch and retains the blade in the blade holder.

78. The knife of claim 77, wherein the utility blade comprises a trapezoidal utility blade.

79. A knife comprising:

a handle;

a blade holder slidingly carried by the handle for sliding movement relative to the handle between a fully extended position and a retracted position, the blade holder being constructed and arranged to extend forwardly of the handle when in the fully extended position; and a utility blade mounted to the blade holder for movement with the blade holder relative to the handle, the utility blade having first and second parallel linear edges, a mounting notch formed in the first linear edge, and a cutting edge, wherein when the blade holder is in the fully extended position, the blade is in an operative position in which the utility blade is locked to the blade holder and extends forwardly of the blade holder and handle, wherein a retracted length of the knife when the blade holder is in the retracted position is less than 5 ¼ inches, wherein the utility blade detachably mounts to the blade holder;

wherein the knife further comprises a manually operable blade lock disposed on the blade holder, the blade lock being manually movable from a locked position, in which the lock retains the blade in the blade holder, to a released position that allows the blade to be manually disengaged from the blade holder;

wherein the entire blade lock is slidably movable with the blade holder relative to the handle when the blade holder slides between the fully extended and retracted positions; and wherein the blade lock comprises a protrusion that engages the mounting notch when the blade lock is in the locked position, but does not engage the mounting notch when the blade lock is in the released position.

80. A knife comprising:

a handle; and a blade holder slidingly carried by the handle for sliding movement relative to the handle between an extended position and a retracted position, the blade holder being shaped and configured to attach to a utility blade, the blade holder being constructed and arranged to extend forwardly of the handle when in the extended position, wherein the blade holder is shaped and configured to attach to a trapezoidal utility blade, and wherein a retracted length of the knife when the blade holder is in the retracted position is less than 5 ¼ inches, wherein the blade holder comprises a first surface configured and arranged to mate with an upper linear edge of the trapezoidal blade when the blade is attached to the blade holder, and a second surface facing the first surface, the second surface being configured and arranged to mate with a lower linear cutting edge of the trapezoidal blade when the blade is attached to the blade holder, wherein the knife further comprises a manually operable blade lock disposed on the blade holder, the blade lock being manually movable from a locked position, in which the lock is configured and arranged to retain the blade in the blade holder, to a released position configured and arranged to allow the blade to be manually disengaged from the blade holder, wherein the blade lock comprises a protrusion that is configured and positioned to engage a mounting notch in the upper linear edge of the blade when the blade lock is in the locked position, wherein the protrusion is configured and positioned so as to not engage the mounting notch when the blade lock is in the released position, and wherein the blade lock is movable between the locked and released positions when the blade holder is in the extended position.

* * * * *